US006878903B2

(12) United States Patent
Duba

(10) Patent No.: US 6,878,903 B2
(45) Date of Patent: Apr. 12, 2005

(54) GLOW PLUG

(75) Inventor: David E. Duba, Shelbyville, IN (US)

(73) Assignee: Fleming Circle Associates, LLC, Shelbyville, IN (US)

( * ) Notice: Subject to any disclaimer, the term of this patent is extended or adjusted under 35 U.S.C. 154(b) by 22 days.

(21) Appl. No.: 10/417,440

(22) Filed: Apr. 16, 2003

(65) Prior Publication Data

US 2004/0206742 A1 Oct. 21, 2004

(51) Int. Cl.[7] ..... F23Q 7/22
(52) U.S. Cl. ..... 219/270; 219/264; 219/544
(58) Field of Search ..... 219/267, 270, 219/262, 263, 264, 544; 123/145 A, 145 R; 361/264–266

(56) References Cited

U.S. PATENT DOCUMENTS

| | | | | |
|---|---|---|---|---|
| 2,884,920 A | * | 5/1959 | Moule et al. | 123/145 R |
| 4,177,785 A | | 12/1979 | Sundeen | |
| 4,196,712 A | | 4/1980 | Kawamura et al. | |
| 4,312,307 A | * | 1/1982 | Cooper | 123/145 A |
| 4,350,876 A | | 9/1982 | Kubota et al. | |
| 4,399,781 A | | 8/1983 | Tsukasaki | |
| 4,442,804 A | | 4/1984 | Morgan et al. | |
| 4,452,191 A | | 6/1984 | Steele | |
| 4,477,717 A | | 10/1984 | Walton | |
| 4,516,543 A | | 5/1985 | Abe et al. | |
| 4,530,321 A | | 7/1985 | Caron et al. | |
| 4,606,306 A | | 8/1986 | Caron et al. | |
| 4,634,837 A | | 1/1987 | Ito et al. | |
| 4,934,349 A | | 6/1990 | Demizu | |
| 5,130,517 A | * | 7/1992 | Schmid et al. | 219/270 |
| 5,156,050 A | * | 10/1992 | Schmid et al. | 73/628 |
| 5,158,050 A | * | 10/1992 | Hawkins et al. | 123/145 A |
| 5,172,664 A | * | 12/1992 | Mueller et al. | 123/145 A |
| 5,251,589 A | * | 10/1993 | Duba et al. | 123/145 A |
| 5,319,180 A | * | 6/1994 | Locher et al. | 219/270 |
| 5,327,870 A | | 7/1994 | Boisvert et al. | |
| 5,521,356 A | | 5/1996 | Bauer | |
| 5,834,736 A | | 11/1998 | Kawamura | |
| 6,396,028 B1 | * | 5/2002 | Radmacher | 219/270 |
| 6,420,683 B1 | | 7/2002 | Chiba et al. | |
| 2002/0060214 A1 | | 5/2002 | Chiba et al. | |
| 2004/0060924 A1 | * | 4/2004 | Burkhart | 219/497 |

FOREIGN PATENT DOCUMENTS

| | | |
|---|---|---|
| JP | 83422 | 5/1981 |

* cited by examiner

*Primary Examiner*—Teresa J. Walberg
(74) *Attorney, Agent, or Firm*—Howard & Howard

(57) ABSTRACT

A glow plug assembly is disclosed having a plug body for mounting the assembly into an engine. A sheath extends from the plug body and has a distal tip portion spaced from the plug body. A first heating element having a fixed resistance is disposed within the sheath and extends from the plug body into the tip portion. A second heating element having a variable resistance is located next adjacent the tip portion separated from the plug body by the first heating element and connected in series with the first heating element. A terminal extends outwardly from the plug body and a power supply is connected to the terminal. A controller between the power supply and the terminal intermittently applies voltage to the terminal for a predetermined time period to maintain an operating temperature. A sensor senses a combined resistance of the first heating element and the second heating element to maintain the combined resistance with the controller by intermittently applying the voltage.

38 Claims, 2 Drawing Sheets

FIG - 2
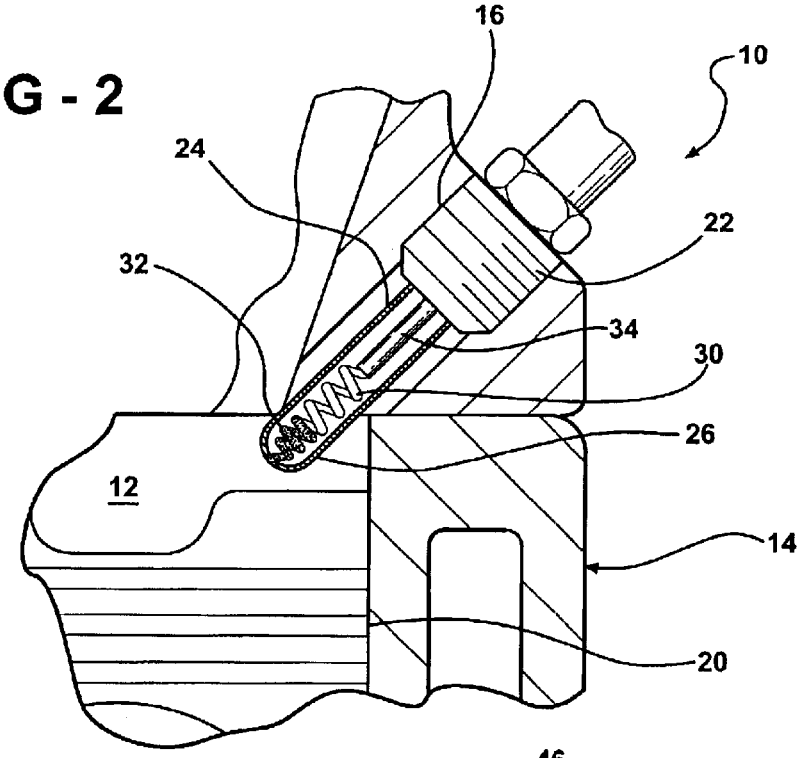
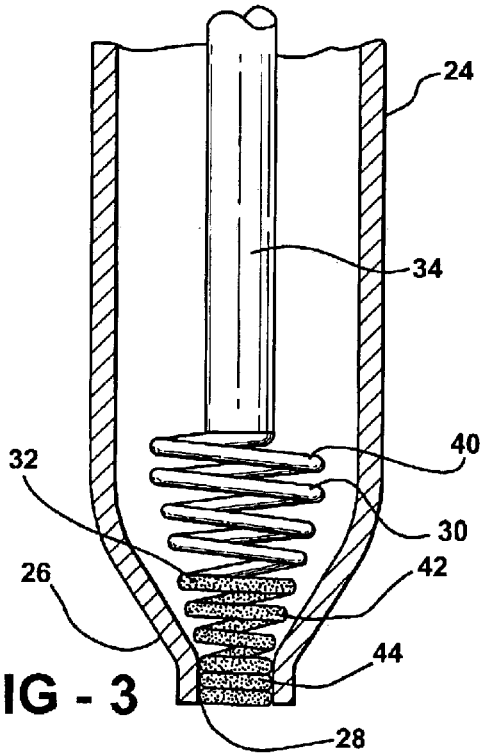
FIG - 3
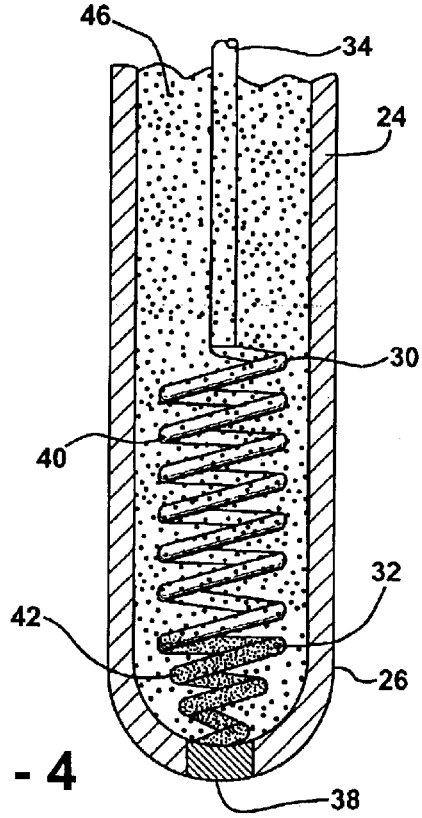
FIG - 4

GLOW PLUG

BACKGROUND OF THE INVENTION

1. Field of the Invention

The subject invention relates to a glow plug assembly for extending into a combustion chamber of a direct injection engine to ignite fuel.

2. Description of the Related Art

Various related art assemblies disclose glow plug assemblies for extending into combustion chambers of direct injection engines to ignite fuel. These assemblies generally include a plug body for mounting into the engine, a sheath supported by and extending from the plug body and having a distal tip portion spaced from the plug body, and a heating element disposed within the sheath to heat the sheath to an operating, or starting, temperature.

One of the major objections to the use of diesel engines in automotive applications has been the delay in starting the engines, which has resulted from the time required to heat the glow plugs to the starting temperature. As a consequence, there has been a continuing attempt by designers and manufacturers to reduce the time required to heat the glow plug to incandescence or the ignition temperature which is on the order of 1000 degrees C.

Typically, the sheath is closed at the outer end and sealed at its inner end to a plug body which is threadedly received in an opening in the cylinder head of the engine, to mount the sheath in a location in the engine cylinder to ignite the air-fuel mixture. The sheath is heated by the heating element, which is a coiled resistance material supported coaxially within the sheath by an insulator. The insulator electrically insulates the coiled heating element from the sheath. The outer end of the heating element is connected to the tip of the sheath and the inner end is connected to an electrical terminal, which is insulated from the plug body. The terminal and the sheath are connected to a twelve volt DC supply voltage to supply current to heat the coiled heating element.

In an effort to decrease the time to heat the glow plug to the ignition temperature, many alternative variations have been made in the basic elements described above. The high temperatures and pressures of 1100 degree C. and 400 psi within the engine cylinder have limited the flexibility in design approaches that might be taken. In addition, the combustion gases within the engine cylinders tend to be very corrosive. The sheath is formed of a metal and has a tendency to decrease the effectiveness of the heating element in attaining the ignition temperature, since it presents a significant mass or heat sink to be raised in temperature by the heating element. However, the hostile nature of the environment within the engine cylinder has necessitated the continued use of the protective sheath. Attempts made at providing glow plugs with exposed heating elements, unprotected by a sheath have been unsuccessful due to the short life of the heating elements. The sheath may be formed of a high temperature, corrosive resistant alloy such as a nickel, chromium, iron alloy. One such alloy is sold under the trademark Inconel.

Alternative designs for the coiled heating element have been employed to reduce heat-up times. Dual elements having one resistance heating element portion and a control portion made of a material having a positive temperature coefficient (PTC) of resistance have been used in glow plugs distributed commercially and disclosed in issued patents.

Examples of patents directed to dual element glow plugs include U.S. Pat. No. 4,556,781 to Bauer; U.S. Pat. No. 4,423,309 to Murphy; U.S. Pat. No. 4,211,204 to Glauner et al.; U.S. Pat. No. 4,477,717 to Walton; and U.S. Pat. No. 5,521,356 to Bauer. The control resistance portions are typically made of nickel or some other material which increases in resistance by a factor of 4 to as much as 12 when heated from room temperature to a temperature of 1000 degrees C. Such control resistance permits the glow plug to be designed to provide a very high initial current which is decreased as the glow plug reaches ignition temperature so as to prevent damage of the heating element from the sustained high current level. However, in each of these references, the PTC material is not located solely in the portion of the sheath that is disposed within the combustion chamber. Therefore, the PTC material can not be used to determine the operating conditions of the tip of the sheath and can not optimize the operation of the glow plug.

Other approaches involved concentrating the heating element toward the end of the sheath to minimize the heat loses and increase the effectiveness of the heating element. The patent to Testerini U.S. Pat. No. 3,158,787 is an example of a glow plug having such a heating element concentrated toward the tip of the sheath. The various approaches described above and others have been partially successful in lowering heat-up times for glow plugs, but the times are still generally in excess of ten seconds. One of the problems with existing commercially available glow plugs is that they start to glow or reach incandescence toward the middle of the sheath and not at the outer end. This condition is undesirable from two standpoints.

First, when the concentration of heat is between the ends of the sheath, the plug usually must have the total length of the sheath heated before the ignition temperature is achieved. Since the plug body conducts heat away or is a heat sink, the amount of heat required to reach ignition is greater, requiring a longer time. It would be preferable to heat the tip of the glow plug to incandescence first, to minimize heat loss and shorten the heat-up time.

The second problem associated with the failure to heat the tip of the glow plug relates to the present trend toward eliminating separate combustion chambers for mixing air and fuel, and the trend toward direct injection in which the fuel is injected into a restricted space between the face of the piston and the adjacent wall of the cylinder head. It has been common in the past to have diesel engines formed with separate chambers into which the fuel was injected, mixed with air, and ignited. The glow plug for igniting the air-fuel mixture would often extend an inch or more into this chamber. Many current engines are designed with reduced size fuel mixing chambers or with the fuel injected directly into the area at the face of the piston.

These new designs leave much less space for the location of the glow plug. It is important to maintain the glow plug separated enough from the fuel injector so that the fuel is not sprayed directly on the sheath, heat up time occurs before injection starts. As a consequence of the limited spaced available for mounting the glow plug, the current size of the plugs, and the fact that heat-up begins at the midpoint of the sheath rather than at the tip, renders the current glow plugs less than satisfactory. It would be preferable to have a shorter sheath in the glow plug and have the heat-up occur first at the tip rather than at the midpoint. With such conditions, less length of the sheath would be required to extend into the combustion area and the effective ignition part of the glow plug could be positioned in the optimum location to ignite the air-fuel mixture.

Various approaches have been followed in connecting the coiled heating element to the tip of the sheath to complete the heating circuit for the glow plug. U.S. Pat. No. 4,477,717 to Walton shows the axially extending end of the heating element extending through an opening in the end of the sheath when it is attached. U.S. Pat. No. 4,281,451 discloses the use of sintered metal to connect the element and the sheath. German Patent No. DE 3,003,799 discloses a coiled heating element that is welded through an opening in the sheath to connect the element and sheath and seal the tip of the sheath. The '799 patent is directed to a dual element glow tube and at the outer end of the heating element where it is welded to the sheath, a number of the heating element coils are engaged to short them out and reduce the heating effect in the outermost coils of the heating element.

BRIEF SUMMARY OF THE INVENTION

The subject invention provides a glow plug assembly for extending into a combustion chamber of a direct injection engine to ignite fuel. The assembly includes a plug body for mounting into the engine and a sheath supported by and extending from the plug body and having a distal tip portion spaced from the plug body. A first heating element having a fixed resistance is disposed within the sheath and extends from the plug body into the tip portion. A second heating element having a positive temperature coefficient of resistance is located next adjacent the tip portion and is separated from the plug body by the first heating element and connected in series with the first heating element.

Accordingly, the subject invention provides a glow plug that is capable of detecting and sensing the specific operating conditions within the combustion chamber at the tip of the sheath by having the second heating element located next adjacent the tip. Further, the subject invention provides an improved glow plug which heats the outer tip to the fuel ignition temperature prior to heating the inner portions of the protective sheath to such ignition temperature.

BRIEF DESCRIPTION OF THE SEVERAL VIEWS OF THE DRAWINGS

Other advantages of the subject invention will be readily appreciated as the same becomes better understood by reference to the following detailed description when considered in connection with the accompanying drawings wherein:

FIG. 2 is an exploded view of a portion of the glow plug assembly along Line 2 in FIG. 1 illustrating the second heating element being disposed entirely in the combustion chamber to detect operating conditions of the tip portion;

FIG. 3 is cross-sectional view of a glow plug of the subject invention at an intermediate stage of construction prior to welding the heating element to the protective sheath; and FIG. 4 is a cross-sectional view of a glow plug constructed in accordance with the subject invention.

DETAILED DESCRIPTION OF THE INVENTION

Figure 1:
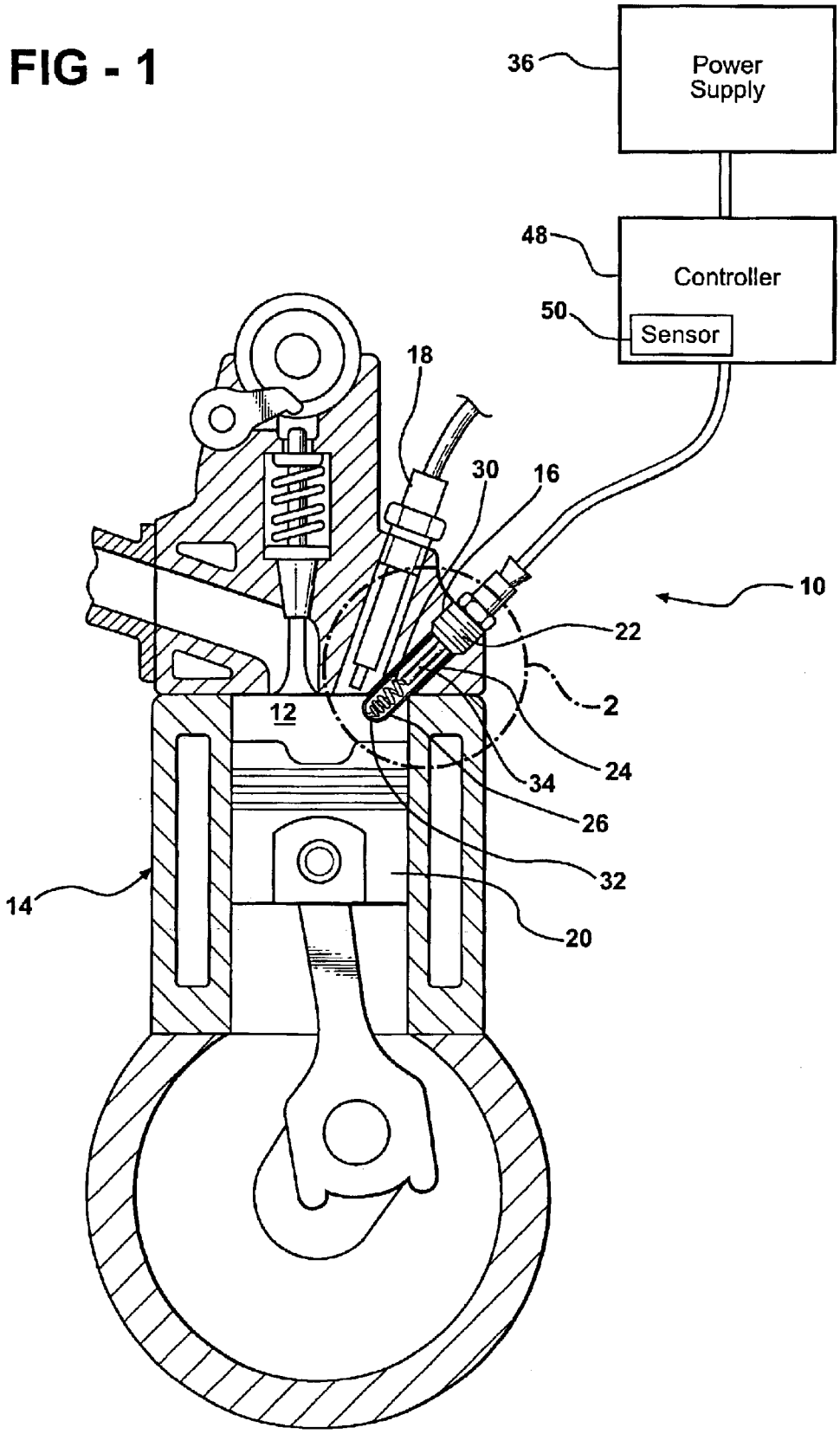
FIG. 1 is a cross-sectional view of a cylinder of a glow plug assembly mounted in a diesel engine according to the subject invention.

Referring to the Figures, wherein like numerals indicate like or corresponding parts throughout the several views, a glow plug assembly for extending into a combustion chamber 12 of a direct injection engine 14 to ignite fuel is shown generally at 10 in FIG. 1. It is known by those skilled in the art that the fuel to be ignited includes a mixture of air and fuel.

The assembly 10 includes a plug body 16 for engaging the engine 14 and mounting the assembly 10 into the engine 14. The plug body 16 may be mounted in a cylinder head of the engine 14, however, one skilled in the art may be able to mount the plug body 16 to an engine block. A fuel injector 18 sprays the fuel into the combustion chamber 12. A piston 20 reciprocates within the combustion chamber 12 as is known in the art to mix air with the fuel. The combustion chamber 12 has a limited volume, leaving little space into which the glow plug assembly 10 may extend. This limited projection allows the glow plug 10 to be located so that it is out of the direct fuel spray from the injector, while still being in position to ignite the air-fuel mixture, as described below. In one embodiment, the plug body 16 includes a threaded portion 22 which is adapted to secure the glow plug 10 in the cylinder head wall. It is to be appreciated that other connections may be employed to secure the plug body 16 to the cylinder head without deviating from the subject invention.

A sheath 24 extends from the plug body 16 into the combustion chamber 12. The sheath 24 has a distal tip portion 26 spaced from the plug body 16. The sheath 24 is further defined as being formed of high heat strength alloy. The tip portion 26 also has an aperture 28 as will be described below. The tip portion 26 of the assembly 10 is located entirely within the combustion chamber 12 and is subjected to operating conditions of the combustion chamber 12. As the sheath 24 heats up to an operating temperature capable of igniting the fuel, the piston 20 will be actuated to draw in air into the combustion chamber 12. As the piston 20 continues to crank, the air that is drawn into the combustion chamber 12 cools the tip portion 26 of the sheath 24. The tip portion 26 may extend about a quarter of an inch or less into the combustion chamber 12. The remaining portion of the sheath 24 extends through the cylinder head and is not subjected to the same operating conditions.

Referring to FIG. 2, a first heating element 30 is disposed within the sheath 24 and extends into the tip portion 26. The first heating element 30 has a fixed resistance, which does not substantially change during changes in temperature of the first heating element 30. In one embodiment, the first heating element 30 has a resistance of from 0.3 ohms to 1.2 ohms, depending upon the particular application of the glow plug assembly 10. The first heating element 30 may be helical in shape.

A second heating element 32 is located next adjacent the tip portion 26 separated from the plug body 16 by the first heating element 30 and connected in series with the first heating element 30. The second heating element 32 is located entirely within the tip portion 26 so that it can sense and respond to the changes of the operating conditions within the combustion chamber 12. If the second heating element 32 extends into the cylinder head, then the second heating element 32 does not truly detect the operating conditions because it is not subjected entirely to the conditions in the combustion chamber 12. In one embodiment, the second heating element 32 is also helical in shape. However, one skilled in the art might use a linearly shaped heating element, without deviating from the subject invention. The second heating element 32 has a positive temperature coefficient (PTC) of resistance, which exhibits an increase in the resistance with the increases in temperature of the second heating element 32. In other words, the second heating element 32 has a variable resistance. Therefore, once the second heating element 32 reaches an operating temperature, the second heating element 32 will have a predetermined resistance. As the piston 20 cranks and cools the tip portion 26 of the sheath 24, the resistance of the second heating element 32 will decrease because it is entirely subjected to those operating conditions within the combustion chamber 12. For example, the second heating element 32 may have a resistance range at 25 degrees Celsius of from 0.01 ohms to 0.2 ohms and at 1100 degrees Celsius of from 0.9 ohms to 1.3 ohms. The second heating element 32 may be formed from at least one of iron and cobalt alloy. In another example, the material may have an iron content of from 1 part to 15 parts based upon 100 parts of material and a cobalt content of from 85 parts to 99 parts based upon 100 parts of material.

When the first heating element 30 and the second heating element 32 are connected in series, they are wound in a helical shape with loops of decreasing diameter, to form a tapered configuration at the outer end where the second heating element 32 is connected to the sheath 24, as will be described below. In series, the first heating element 30 and the second heating element 32 have a combined resistance of the first heating element 30 plus the resistance of the second heating element 32. For example, at 25 degrees Celsius the combined resistance may be from 0.25 ohms to 0.65 ohms and at 1100 degrees Celsius from 1.05 ohms to 1.75 ohms.

The purpose of the sheath 24 is to protect the first heating element 30 and the second heating element 32 from the high temperatures, high pressures and corrosive gases present within the combustion chamber 12.

Referring back to FIG. 1, a terminal 34 extends outwardly from the plug body 16 and is electrically connected to the first heating element 30 for conducting electricity to generate heat in the first heating element 30 and the second heating element 32. The terminal 34 is electrically insulated from the plug body 16 and extends through the plug body 16 to connect to the inner end of the first heating element 30. A power supply 36 is connected to the terminal 34 for supplying an electrical current through the first heating element 30 and the second heating element 32 at a voltage to generate an operating temperature capable of igniting the fuel. For example, the power supply 36 may be a twelve volt battery.

The first heating element 30 and the second heating element 32 transfer the generated heat to the tip portion 26 of the sheath 24. The heat eventually spreads up the sheath 24 towards the plug body 16. However, in order to reach the operating temperature as quickly as possible, the assembly 10 concentrates the heat at the tip portion 26. Since the tip portion 26 is located entirely in the combustion chamber 12 the tip portion 26 is subject to the operating conditions within the combustion chamber 12. Although the materials of the sheath 24 is heat conductive, it still acts as a heat sink that must be brought up to temperature along with the first heating element 30 and the second heating element 32. It is largely because of this heat sink effect that it has been difficult to reduce the heat-up time as much as desired to rival a spark ignition engine.

The tip further defines the aperture 28 for receiving the second heating element 32 such that the second heating element 32 is melted to fill the aperture 28 thereby forming a core 38 of PTC material at the tip of the sheath 24 to incandescence the tip prior to the sheath 24 inward of the tip.

The assembly 10 of the subject invention is formed by connecting the first heating element 30 to the second heating element 32, preferably by welding. The first and second heating elements 30, 32 have the helical shape with a portion 40 of the first heating element 30 having a plurality of constant diameter turns connected to a portion 42 of the second heating element 32 having turns of decreasing diameter and more closely spaced turns. At the tip portion 26, the second heating element 32 has a plurality of constant diameter turns 44 which are in contact with each other within the aperture 28.

The second heating element 32 may be connected to the sheath 24 by welding with an inert atmosphere to form the core 38. In welding the second heating element 32 to the sheath 24, the inert atmosphere prevents oxidation from entering the sheath 24 through the opening. The core 38 is melted during the welding process along with a portion of the sheath 24. The core 38 is composed largely of the second heating element 32 with a small amount of the sheath 24 material at the edges of the mass. The mass seals the end of the sheath 24 and provides a good electrical and heat conductive path between the element and the sheath 24.

By having the second heating element 32 forming the core 38, this effectively extends the second heating element 32 to the tip of the sheath 24 and removes or substitutes for that portion of the sheath 24 that had functioned as a heat sink at the tip portion 26 of the sheath 24. The heating of the tip portion 26 of the sheath 24 is further enhanced by the fact that the tapered coils of the heating element are more closely or densely arranged, and are positioned closer to the hemispherical tip of the sheath 24 than are the coils nearer the plug body 16. This use of the core 38 and the arrangement of the coils with respect to the tip portion 26 causes the tip to become a net contributor to the heating process as compared to being a heat sink in the prior art glow plug 10 configurations. As a consequence, the tip portion 26 of the sheath 24 reaches the desired ignition temperature more rapidly than the prior art and in as little as 3 seconds in constructed embodiments. The core 38 or mass of PTC material at the tip portion 26 of the sheath 24 is part of the series circuit including the first heating element 30 and the protective sheath 24. The PTC characteristics of the second heating element 32 and core 38 causes the initial current flow to be very high, since the protective sheath 24 is a low resistance element in the circuit and contributes little to restricting the value of the current. This current through the tip core 38 delivers Joule heating to the tip of the sheath 24, where it tends to be much more effective than heating the sidewall of the sheath 24 by conduction through the magnesium oxide outwardly from the heating element. The tapered turns of the heating element are more closely spaced to each other and are close to the wall of the hemispherical tip, thus concentrating the heating at the tip portion 26 of the sheath 24 rather than at the sidewalls.

Referring to FIG. 4, after the sheath 24 is formed, an insulator 46 fills the sheath 24 to prevent heat from dissipating to the sheath 24 walls prior the tip portion 26. The insulator 46 also supports the first heating element 30 and the second heating element 32 in spaced relation to the sheath 24. Preferably, the insulator 46 is magnesium oxide. The compacted magnesium oxide is employed within the sheath 24 and surrounds the turns of the first and the second heating elements 30, 32. To assure good compaction of the magnesium oxide, the sheath 24 is rolled or swaged to decrease its diameter and further compact the magnesium oxide forming the assembly 10 shown in FIG. 4. The heat conduction through the magnesium oxide is necessary to not only heat the sheath 24 but also to prevent burnout of the heating elements 30, 32 as a result of the high currents carried therein. It should be understood that the magnesium oxide is not introduced into the sheath 24 until after welding.

This process, which is commonly used in the fabrication of sheathed heaters in general and glow plugs 10 in particular, causes the sheath 24 to elongate at the time it is reduced in diameter. However, there is little elongation in the area of the tip portion 26, with the result that the turns of the portion are more closely spaced to each other and remain closely spaced with respect to the hemispherical tip wall.

Referring again to FIG. 1, the subject invention further includes a controller 48 disposed between the power supply 36 and the terminal 34 for intermittently applying the voltage to the terminal 34 for a predetermined time period to maintain the operating temperature. Preferably, the controller 48 is a pulse width modulation controller 48. A sensor 50 is included in the controller 48 for sensing the combined resistance of the first heating element 30 and the second heating element 32 as the first heating element 30 and the second heating element 32 obtain the operating temperature such that the controller 48 maintains the combined resistance at a predetermined resistance by intermittently applying the voltage.

In operation, the controller 48 operates the power supply 36 for a predetermined time to raise the temperature of the first heating element 30 and the second heating element 32 to the operating temperature. It is to be appreciated that the controller 48 may continue to apply a small voltage for sensing the resistance, instead of turning the power supply 36 off without deviating from the subject invention. The sensor 50 detects a rise in the combined resistance through the first heating element 30 and the second heating element 32 by applying a small current for a small amount of time to sample the combined resistance. However, since the first heating element 30 has a fixed resistance, as the temperature rises, the sensor 50 primarily detects the change of resistance in the second heating element 32. The sensor 50 then transmits the combined resistance to the controller 48 and the controller 48 can then determine a temperature at the tip portion 26. The controller 48 continues to apply voltage until the operating temperature is reached. Once the engine 14 begins to crank and the piston 20 draws air into the combustion chamber 12, the tip portion 26 cools. Because the second heating element 32 is disposed next adjacent the tip portion 26 and is located entirely within the combustion chamber 12, this causes the resistance of the second heating element 32 to decrease in response to the cooling tip portion 26. The sensor 50 senses the decreases in the resistance at which point the controller 48 then supplies a voltage to increase the temperature of the second heating element until the combined resistance is reached. If the second heating element 32 were located within the tip portion 26 and the cylinder head, then it would not be an accurate gauge of the operating conditions within the combustion chamber 12, thereby making operation of the glow plug assembly 10 inefficient. However, in the subject invention, since the second heating element 32 is next adjacent the tip portion 26, then the controller 48 can optimize the operating temperature of the tip portion 26.

Obviously, many modifications and variations of the subject invention are possible in light of the above teachings. The invention may be practiced otherwise than as specifically described within the scope of the appended claims.

What is claimed is:

1. A glow plug assembly for extending into a combustion chamber of a direct injection engine to ignite fuel, said assembly comprising:

a plug body for mounting into the engine;

a sheath supported by and extending from said plug body and having a distal tip portion spaced from said plug body;

a first heating element having a fixed resistance for coupling to a power supply and disposed within said sheath and extending from said plug body into said tip portion; and a second heating element having a positive temperature coefficient of resistance disposed entirely within said tip portion and connected to said tip portion for sensing temperature differences occurring at said tip portion and connected in series with said first heating element such that said first heating element separates said second heating element from said plug body.

2. An assembly as set forth in claim 1 wherein said second heating element is further defined as having a resistance range at 25 degrees Celsius of from 0.01 ohms to 0.2 ohms and at 1100 degrees Celsius of from 0.9 ohms to 1.3 ohms.

3. An assembly as set forth in claim 2 further comprising a combined resistance of said first heating element and said second heating element at 25 degrees Celsius of from 0.25 ohms to 0.65 ohms and at 1100 degrees Celsius of from 1.05 ohms to 1.75 ohms.

4. An assembly as set forth in claim 3 wherein said second heating element is further defined as being formed from a material selected from at least one of iron and cobalt.

5. An assembly as set forth in claim 4 wherein said material is further defined as having an iron content of from 1 part to 15 parts based upon 100 parts of material and a cobalt content of from 85 parts to 99 parts based upon 100 parts of material.

6. An assembly as set forth in claim 3 further comprising a terminal extending outwardly from the plug body and being connected to said first heating element for conducting electricity to generate heat in said first heating element and said second heating element.

7. An assembly as set forth in claim 6 further comprising a power supply connected to said terminal for supplying an electrical current through said first heating element and said second heating element at a voltage to generate an operating temperature capable of igniting the fuel.

8. An assembly as set forth in claim 7 further comprising a controller disposed between said power supply and said terminal for intermittently applying said voltage to said terminal for a predetermined time period to maintain said operating temperature.

9. An assembly as set forth in claim 8 wherein said controller is further defined as a pulse width modulation controller.

10. An assembly as set forth in claim 8 further comprising a sensor disposed between said first heating element and said controller for sensing said combined resistance of said first heating element and said second heating element as said first heating element and said second heating element obtain said operating temperature such that said controller maintains said combined resistance at a predetermined resistance by intermittently applying said voltage.

11. An assembly as set forth in claim 10 wherein said tip further defines an aperture for receiving said second heating element such that said second heating element is melted to fill said aperture thereby forming a core of positive temperature coefficient of resistance material at said tip of said sheath to incandescence said tip prior to said sheath inward of said tip.

12. An assembly as set forth in claim 11 further comprising an insulator filling said sheath and supporting said first heating element and said second heating element in spaced relation to said sheath.

13. An assembly as set forth in claim 12 wherein said insulator is further defined as magnesium oxide.

14. An assembly as set forth in claim 12 wherein said first heating element and said second heating element are further defined as being helical in shape.

15. An assembly as set forth in claim 13 wherein said sheath is further defined as being formed of high heat strength alloy.

16. An assembly as set forth in claim 1 wherein said sheath defines an aperture for receiving said second heating element.

17. An assembly as set forth in claim 16 further comprising a core of positive temperature coefficient disposed in said aperture such that said core is exposed for sensing temperature differences in the combustion chamber.

18. An assembly as set forth in claim 17 wherein said core is further defined as a mixture of said sheath and said second heating element.

19. An assembly as set forth in claim 17 wherein said core is further defined as a mixture of said sheath and said temperature sensor.

20. An assembly as set forth in claim 16 wherein said second heating element is further defined as having constant diameter turns within said aperture.

21. An assembly as set forth in claim 20 wherein said constant diameter turns are further defined as contacting one another.

22. A system for controlling emissions from a diesel engine from within a combustion chamber through improved temperature sensing while igniting fuel, said system comprising:

a glow plug assembly comprising a plug body for mounting into the engine and a sheath supported by and extending from said plug body and having a distal tip portion spaced from said plug body for extending into the combustion chamber and said tip portion defining an aperture; and said assembly further comprises a first heating element having a fixed resistance for coupling to a power supply and extending from said plug body into said tip portion and a second heating element having a positive temperature coefficient of resistance disposed entirely within said tip portion and received in said aperture such that said second heating element is exposed for sensing temperature differences occurring within the combustion chamber.

23. A system as set forth in claim 22 wherein said second heating element is further defined as connected in series with said first heating element such that said first heating element separates said second heating element from said plug body.

24. A system as set forth in claim 23 further comprising a sensor coupled to said glow plug assembly sensing a resistance of said second heating element as a function of temperature increases and decreases at said tip portion within the combustion chamber in response to operation of the engine.

25. A system as set forth in claim 24 further comprising a controller communicating with said sensor for intermittently applying a voltage to said glow plug assembly in response to said temperature increases and decreases within said tip portion.

26. A system as set forth in claim 25 further comprising a power supply coupled to said first heating element for supplying an electrical current at a voltage to generate an operating temperature capable of igniting the fuel.

27. A system as set forth in claim 23 wherein said second heating element is further defined as having constant diameter turns within said aperture.

28. A system as set forth in claim 27 wherein said constant diameter turns are further defined as contacting one another.

29. A system for controlling emissions from a diesel engine from within a combustion chamber through improved temperature sensing while igniting fuel, said system comprising:

a glow plug assembly comprising a plug body for mounting into the engine and a sheath supported by and extending from said plug body and having a distal tip portion spaced from said plug body for extending into the combustion chamber and said tip portion defining an aperture;

said assembly further comprises a first heating element having a fixed resistance for coupling to a power supply and extending from said plug body into said tip portion and a second heating element having a positive temperature coefficient of resistance disposed entirely within said tip portion and received in said aperture such that said second heating element is exposed for sensing temperature differences occurring within the combustion chamber; and a controller intermittently applying a voltage to said glow plug assembly in response to temperature increases and decreases within said tip portion.

30. A system as set forth in claim 29 wherein said controller is further defined as adjusting an amount of voltage to be applied to said glow plug to maintain an operating temperature in response to said second heating element sensing temperature differences at said tip portion.

31. A system as set forth in claim 29 further comprising a power supply coupled to said first heating element for supplying an electrical current at a voltage to generate an operating temperature capable of igniting the fuel.

32. A system as set forth in claim 29 wherein said second heating element is further defined as having constant diameter turns within said aperture.

33. A system as set forth in claim 32 wherein said constant diameter turns are further defined as contacting one another.

34. A glow plug assembly for extending into a combustion chamber of a direct injection engine to ignite fuel, said assembly comprising:

a plug body for mounting into the engine;

a sheath supported by and extending from said plug body and having a distal tip portion spaced from said plug body;

a first heating element having a fixed resistance disposed within said sheath and extending from said plug body into said tip portion for coupling to a power supply; and a temperature sensor disposed entirely within said tip portion and connected to said tip portion for sensing temperature differences occurring at said tip portion and connected in series with said first heating element such that said first heating element separates said temperature sensor from said plug body.

35. An assembly as set forth in claim 34 wherein said sheath defines an aperture for receiving said temperature sensor.

36. An assembly as set forth in claim 35 further comprising a core of positive temperature coefficient disposed in said aperture such that said core is exposed for sensing temperature differences in the combustion chamber.

37. An assembly as set forth in claim 35 wherein said temperature sensor is further defined as having constant diameter turns within said aperture.

38. An assembly as set forth in claim 37 wherein said constant diameter turns are further defined as contacting one another.

* * * * *